US008067881B2

(12) United States Patent
Kazmierski

(10) Patent No.: US 8,067,881 B2
(45) Date of Patent: Nov. 29, 2011

(54) LIGHT EMITTING DEVICE

(75) Inventor: Andrei Kazmierski, Himeji (JP)

(73) Assignee: Phoenix Electric Co. Ltd., Himeji-Shi (Hyogo) (JP)

( * ) Notice: Subject to any disclaimer, the term of this patent is extended or adjusted under 35 U.S.C. 154(b) by 125 days.

(21) Appl. No.: 12/647,073

(22) Filed: Dec. 24, 2009

(65) Prior Publication Data

US 2010/0164349 A1 Jul. 1, 2010

(30) Foreign Application Priority Data

Dec. 26, 2008 (JP) ..... 2008-333727

(51) Int. Cl.
*H01J 61/38* (2006.01)
*F21V 7/00* (2006.01)

(52) U.S. Cl. ... 313/111; 313/113; 362/347; 362/296.07; 362/516

(58) Field of Classification Search ..... None
See application file for complete search history.

(56) References Cited

U.S. PATENT DOCUMENTS

| | | | | |
|---|---|---|---|---|
| 7,854,539 | B2 * | 12/2010 | Van Duijneveldt | 362/555 |
| 2004/0223338 | A1 | 11/2004 | Koike et al. | |
| 2006/0082998 | A1 * | 4/2006 | Inoko | 362/268 |
| 2007/0080645 | A1 * | 4/2007 | Smith | 315/83 |
| 2008/0310158 | A1 * | 12/2008 | Harbers et al. | 362/240 |

FOREIGN PATENT DOCUMENTS

| | | | |
|---|---|---|---|
| DE | 102007044740 | A1 | 5/2008 |
| EP | 1538059 | A1 | 6/2005 |
| JP | 2004-111297 | * | 4/2004 |
| JP | 2007-101732 | | 4/2007 |

* cited by examiner

*Primary Examiner* — Ashok Patel
(74) *Attorney, Agent, or Firm* — Lucas & Mercanti, LLP

(57) ABSTRACT

A light emitting device comprises: a concave mirror having one focal point; a plurality of main light sources each of which is arranged between the focal point and a light reflection surface of the concave mirror, and emits light toward the light reflection surface; and a plurality of main lenses each of which is arranged between a corresponding one of the main light sources and the light reflection surface, refracts the light emitted from the corresponding main light source toward the light reflection surface, and produces a virtual image of the main light source on the focal point situated at a backside of the main light source.

5 Claims, 11 Drawing Sheets

LIGHT EMITTING DEVICE

BACKGROUND OF THE INVENTION

1. Field of the Invention

The present invention relates to a light emitting device using a light emitting diode or the like as a main light source, being intended for general illumination and a projector, or the like.

2. Description of the Background Art

As a light emitting device used for general illumination and a projector, a combination of a concave mirror and a discharge lamp or a halogen lamp, in which a focal point of the concave mirror is positioned at a light emitting point of the lamp, is widely used. However, the discharge lamp or the halogen lamp needs large electric power and has large heat discharge. Thus, a light emitting diode (LED, representing a light source that has a lesser amount of light and a lesser amount of heat discharge than the discharge lamp) has been proposed to be used as a light source of the light emitting device. In the light emitting device, in order to compensate for the disadvantage of the LED that the amount of light emission per one unit is smaller than that of the discharge lamp and the halogen lamp, a light emitting device having a plurality of LEDs is developed so as to emit a larger amount of light (for example, patent document 1: Japanese Laid-Open Patent Publication No. 2007-101732, FIG. 4 and FIG. 5).

As shown in FIG. 14, a light emitting device 1 according to patent document 1 includes two LEDs 2, and a concave mirror 4 having arranged thereon divided curved surfaces 3 which are obtained by cutting a surface of revolution, having a focal point, into two along a plane passing through the focal point, and by slightly isolating the divided curved surfaces 3 from each other such that the divided curved surfaces 3 have separated focal points Fx and Fy. The LEDs 2 are arranged at the focal points Fx and Fy, respectively, so as to face the light reflection surfaces 5 of their corresponding divided curved surfaces 3.

According to the light emitting device 1, the light emitted from each of the LEDs 2 is reflected on the corresponding light reflection surface 5. When the light reflection surface 5 constitutes a part of the paraboloid, the reflected light travels as parallel light, whereas when the light reflection surface 5 constitutes a part of an ellipsoid, the reflected light converges on a light converging point. Accordingly, it is possible to use light from a plurality of LEDs 2 more efficiently in the form of the parallel light, or by reducing unnecessary light (=stray light) that does not converge.

However, in the light emitting device 1 of patent document 1, as above described, a surface of revolution having a focal point is divided into a plurality of divided curved surfaces 3, and the divided curved surfaces 3 need to be arranged slightly distant from each other so as to have individual focal points, respectively. That is, a special concave mirror 4 is required and thus, it is impossible to use an ordinary concave mirror having a paraboloid (or an ellipsoid) light reflection surface. The light emitting device 1 has a problem of lack of versatility.

In addition, the above-described special concave mirror 4 has a problem of its manufacturability. That is, in the case of manufacturing the concave mirror 4 with glass, a thickness of the concave mirror 4 needs to be biased in accordance with shapes of the plurality of divided curved surfaces 3, which leads to deterioration in a yield of the material, and which causes difficulty in improving the accuracy of the shape. Moreover, even in the case of using aluminum, the above-described problems are caused, and it is substantially impossible to mold the concave mirror 4 by spinning. Moreover, in the case of using resin, a die for molding the concave mirror 4 will be of a complicated shape, and consequently, a cost for manufacturing the die is increased, and in addition, it will be difficult to improve the accuracy of the shape.

In addition, as above described, the concave mirror 4 has a plurality of focal points, and thus a portion of light, which is emitted from an LED 2 disposed at one focal point, is reflected on a divided curved surface 3 on a side opposite to the divided curved surface 3 facing the focal point, and is consequently converted to certain parallel light or converging light, which limits improvement in efficient use of light.

SUMMARY OF THE INVENTION

A main subject of the present invention is to provide a light emitting device which uses an ordinary concave mirror having a paraboloid or an ellipsoid and having one focal point, and reflects light emitted from a plurality of main light sources on the concave mirror so as to convert the reflected light to parallel light having brightness depending on the number of the main light sources in the case where the light reflection surface has the paraboloid, and so as to convert the reflected light to converging light, on the light converging point, having brightness depending on the number of the main light sources in the case where the light reflection surface has the ellipsoid. Another object of the present invention is to provide a light emitting device capable of reducing unnecessary light (=stray light), and to maximize the efficiency of the light emitted from a plurality of main light sources.

A first aspect of the present invention is directed to a light emitting device 10 comprises:

(1A) a concave mirror 12 having one focal point F1;

(1B) a plurality of main light sources 26 each of which is arranged between the focal point F1 and a light reflection surface 20 of the concave mirror 12, and emits light toward the light reflection surface 20; and (1C) a plurality of main lenses 29 each of which is arranged between a corresponding one of the main light sources 26 and the light reflection surface 20, refracts the light emitted from the corresponding main light source 26 toward the light reflection surface 20, and produces a virtual image S of the main light source 26 on the focal point F1 situated at a backside of the main light source 26.

According to the above invention, the virtual image S of each of the main light sources 26, produced by the corresponding main lens 29 is situated at the focal point F1 of the light reflection surface 20 of the concave mirror 12, and thus as shown in FIG. 4. The light emitted from each main light source 26 and refracted by the corresponding main lens 29 travels as if the light is emitted from the focal point F1 of the light reflection surface 20 of the concave mirror 12 where the virtual image S is situated. With being reflected on the light reflection surface 20 of the concave mirror 12, the light is converted into parallel light in the case where the light reflection surface 20 has a paraboloid, or converges on the light converging point F2 in the case where the light reflection surface 20 has an ellipsoid (FIGS. 5, 6, and 8).

Moreover, when LEDs are used as the main light sources 26, a color temperature of light emitted therefrom varies in a wide range depending on the individual LEDs. When the light reflection surface 20 has an ellipsoid, light emitted from a plurality of main light sources (=LEDs) 26 converges on the light converging point F2. Accordingly, variation in the color temperature of the light from the respective main light sources 26 is uniformized at the light converging point F2, and thus it is possible to provide a light emitting device 10 having less variation in the color temperature of emitted light depending on the individual differences. In the case of parallel light, the same effect as above described will be obtained depending on the degree of mixture of light on the irradiation surface.

Furthermore, in the prevent invention, the virtual image S of each main light source 26 produced by the corresponding main lens 29 is each formed on the focal point F1 situated at the backside of each main light source 26, and thus any one of the main light sources 26 or the main lenses 29 does not interfere with the other main light sources 26 or main lenses 29. Accordingly, it is possible to allocate a plurality of main light sources 26 at different positions, respectively, such that the virtual images S of the main light sources 26 are all situated at the focal point F1 of the light reflection surface 20 of the concave mirror 12. In other words, it is possible to use a plurality of main light sources 26 as one light source by using the "virtual images".

In the present invention, the shape of the concave mirror 12 is not limited to the ellipsoid or the paraboloid as long as the concave mirror 12 has one focal point F1. It is possible to use a free curved surface obtained by combining a plurality of small reflection surfaces, respectively having focal points, so that the respective focal points are collected at an identical point.

As another example (FIG. 9) of the first aspect, the light emitting device 10 may be provided an auxiliary light source 50, which emits light toward an irradiation region formed by light reflected on the concave mirror 12. The auxiliary light source 50 is arranged between reflection regions R in the concave mirror 12. When the reflected light travels as parallel light, a slightly dark region DR, which is generated at the center of the parallel light depending on a degree of overlapping of the parallel light, can be lighted by using the auxiliary light source 50, and consequently it is possible to increase a uniformity ratio of illuminance on the irradiation surface. In the case where the reflected light travels as converging light, it is possible to supplementarily increase the brightness at a light converging point.

A second aspect (FIG. 6 (*a*)) of the present invention is directed to an improved the light emitting device 10 according to the first aspect and the light emitting device comprises:

(3A) a concave mirror 12 having one focal point F1;

(3B) a plurality of main light sources 26 each of which is arranged between the focal point F1 and a light reflection surface 20 of the concave mirror 12, and emits light toward the light reflection surface 20;

(3C) a plurality of main lenses 29 each of which is arranged between a corresponding one of the main light sources 26 and the light reflection surface 20, refracts a majority portion of the light emitted from the corresponding main light source 26 toward the light reflection surface 20, and produces a virtual image S of the main light source 26 on the focal point F1 situated at a backside of the main light source 26; and (3D) a correcting lens 46 which is arranged on an irradiation direction side from the main light sources 26, and refracts light, which is not transmitted through the main lenses 29 and travels toward the irradiation direction while deviating from an irradiation region, such that the light is directed to a predetermined irradiation region.

According to the present aspect, in addition to the invention according to the first aspect, with the correcting lens 46 arranged on the irradiation direction side from the main light sources 26, it is possible to direct light (=stray light) to a predetermined radiation point, the light being not transmitted through the main lenses 29, but traveling toward the irradiation direction while deviating from an irradiation region, and causing "glare" to those who are in the surrounding area. (For example, in the case where the light reflection surface 20 has a paraboloid, a correcting lens 46 is arranged to convert the stray light to parallel light, whereas in the case where the light reflection surface 20 has an ellipsoid, the correcting lens 46 is arranged to cause the stray light to converge on a light converging point F2 of the ellipsoid.) Accordingly, it is possible to use light from a plurality of main light sources 26 more efficiently, and also possible to improve a uniformity ratio of illuminance on the irradiation surface.

As another example (FIG. 6 (*b*)) of the second aspect, the main light source 26 according to the second aspect is modified, and has a feature that a main lens non-transmitted light reflection surface (not shown) is arranged for each of the main light sources 26 on a side toward the concave mirror 12, or a main lens non-transmitted light reflection film 31 is arranged for each of the main light sources 26 on a surface of the side toward the concave mirror 12. Accordingly, the light emitted toward the concave mirror 12 is reflected toward the irradiation direction or toward the light reflection surface 20, whereby the light is directed toward the irradiation region by the main lenses 29 or the correcting lens 46. It is possible to use the light more efficiently.

According to the present invention, as a main effect, it is possible to irradiate an irradiation surface brighter with the use of a plurality of main light sources in proportion to the number of the main light sources while using a conventionally used concave mirror having a focal point. As a subsidiary effect, it is possible to provide a light emitting device which has excellent use efficiency of light.

BRIEF DESCRIPTION OF THE DRAWINGS

FIG. 5 is a diagram showing the light emitting device according to a first embodiment when the same is turned on;

FIG. 8 is a diagram showing a light emitting device according to a second embodiment when the same is turned on;

DESCRIPTION OF THE PREFERRED EMBODIMENTS

Figure 1:
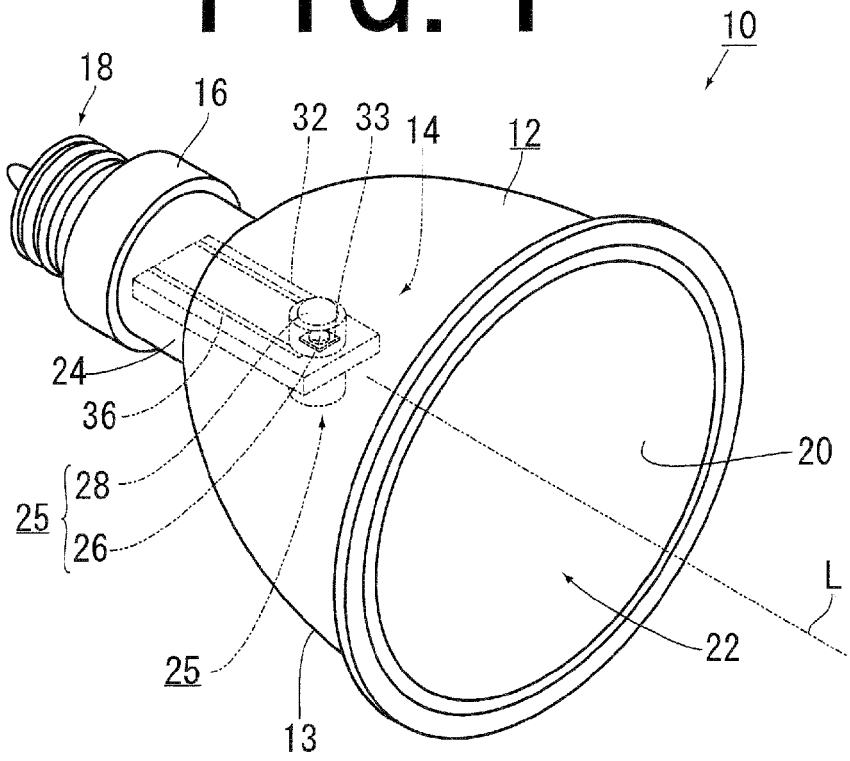
FIG. 1 is a perspective view of a light emitting device according to the present invention.

Hereinafter, the present invention will be described based on examples illustrated in drawings. First, a light reflection surface according to a first embodiment, in which an ellipsoid is used, is described, and then a light reflection surface according to a second embodiment, in which a paraboloid is used, is described. A "correcting lens 46", a "main lens non-transmitted light reflection surface (not shown)", and a "main lens non-transmitted light reflection film 31" are described in a modified first embodiment, and these are also applied to the second embodiment. Moreover, the second embodiment is different from the first embodiment in relation to a shape of a light reflection surface only, and thus, in the second embodiment, description of those component parts which are common to those in the first embodiment is omitted by incorporating the description thereof in the first embodiment, and the different portions are mainly described. In addition, in the present specification, common reference numerals and characters are provided to those component parts which have a common function, and alphabets are added in the case where differentiation is required.

First Embodiment

Figure 2:
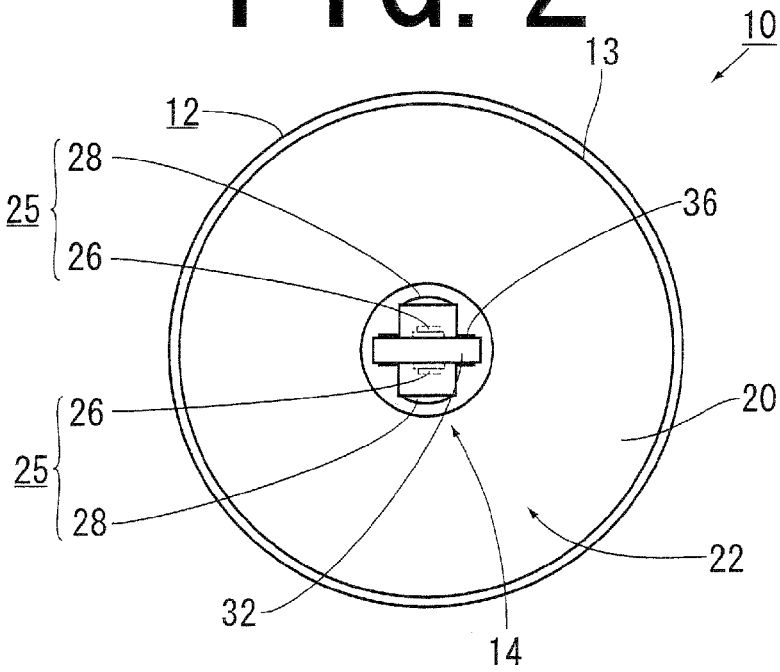
FIG. 2 is a front view showing the light emitting device according to the present invention.
Figure 3:
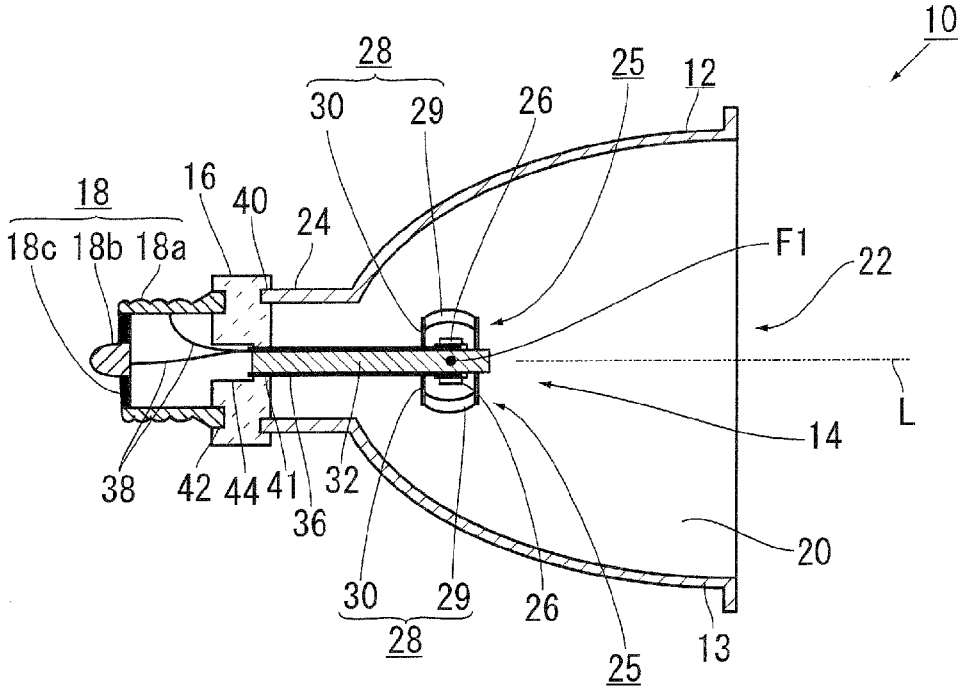
FIG. 3 is a left side cross-sectional view of the light emitting device according to the present invention.

A light emitting device 10 according to the present invention is used for general illumination or for a projector, and comprises, as shown in FIG. 1 to FIG. 3, a concave mirror 12, a light source unit 14, a holder 16 for holding a light source unit 14, and a power supply terminal 18.

The concave mirror 12 has: a light reflection surface 20 which causes light internally emitted to be reflected; a light-emitting opening 22 through which light reflected on the light reflection surface 20 is outputted from the concave mirror 12; and a central fixing cylindrical portion 24 which is arranged at a central bottom portion of the concave mirror 12, and has a holder 16 fixed thereto. A straight line which passes through the center of the concave mirror 12, and is perpendicular to the light-emitting opening 22 is a central axis L of the concave mirror 12.

Glass, aluminum, and the like are used as a material of the concave mirror 12, and the light reflection surface 20 is treated with metal deposition (in the case of using aluminum, alumite treatment may be used, instead of the metal deposition). Moreover, in the case of using glass, an infrared permeable film may be applied onto an outer surface of a main body (cup shaped) 13 having the light reflection surface 20 formed therein. In the present embodiment, a material such as an LED, which has less radiation heat compared to a discharge lamp, is used as a main light source 26. Consequently, "resin" which is less heat-resistant than glass and aluminum may be used as a material for the concave mirror 12.

The light reflection surface 20 according to the first embodiment has an ellipsoid centered on a central axis L. A focal point F1 is situated inside the concave mirror 12, whereas a light converging point F2 is situated outside the concave mirror 12 (both of the focal point F1 and the light converging point F2 may be situated outside the concave mirror 12). The "ellipsoid" has a feature that causes all the light rays emitted from the focal point F1 and reflected on the ellipsoid to converge at the light converging point F2.

The light source unit 14 includes main light sources (LEDs, in the present embodiment) 26 each arranged on the center of a substrate 33, a plurality of main lights 25 each composed of a lens 28 arranged so as to cover a corresponding one of the main light sources 26, and a light source holder 32 having the plurality of main lights 25 fixed on end surfaces thereof. The light source unit 14 is arranged inside the concave mirror 12 so as to be aligned with the central axis L, and to be accommodated at the center of the central fixing cylindrical portion 24 of the concave mirror 12. The base end of the light source unit 14 is fixed with the holder 16 so as to be connected with the power supply terminal 18. In the present embodiment, a case where two sets of main light sources 26 are used. The number of the main light sources 26 is not limited to two, but three (FIGS. 12 and 13) or more main light sources 26 may be applicable.

Each main light source 26 (as with auxiliary light sources 50 described later) is an LED emitting light at a light radiation angle θ of 120°, (light radiation angle θ is not limited to this) when set current is supplied thereto. Alternatively, an organic EL may be used as the light source.

Figure 4:
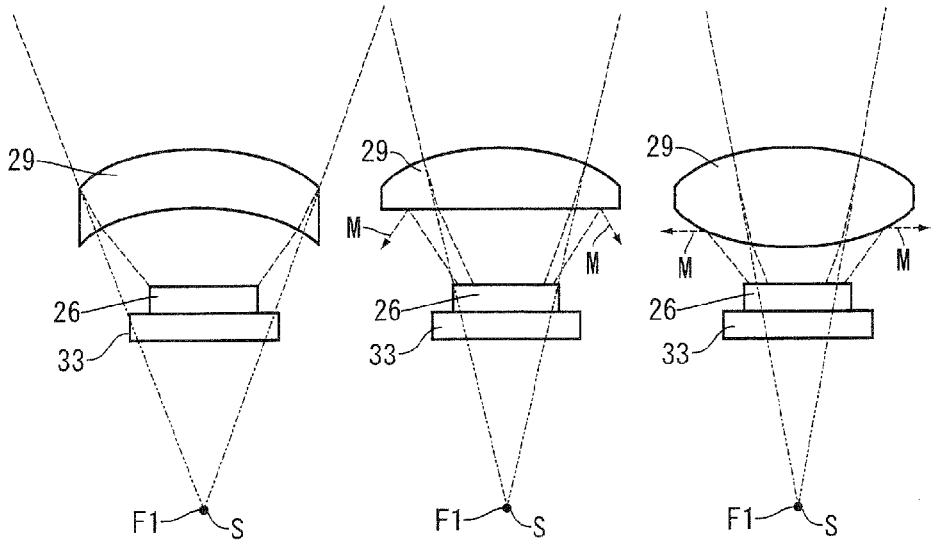
FIG. 4 is a diagram showing types of main lenses.

Each lens 28 includes a main lens 29 arranged so as to face the main light source 26 while having a distance therebetween, and a main lens holder 30 for arranging and holding the main lens 29 at the aforesaid position. As shown in FIG. 4 (*a*), a convex meniscus lens (a lens having a strip shape cross-section, whose one surface is convex, and whose other opposing surface is concave) may be used as the main lens 29. A planconvex lens (FIG. 4 (*b*)), or a biconvex lens (FIG. 4 (*c*)) may be used, alternatively. However, in that case, light M emitted from the main light source 26 to right and left side ends of the main lens 29 (i.e., light incident on a surface of the main lens 29 at a shallow angle) is reflected on the surface of the main lens 29 and becomes stray light M. Thus, the convex meniscus lens is preferably used.

The main lens holder 30 is formed of metal, nontransparent resin, or the like, and has a cylindrical shape (the main lens holder 30 may be formed of translucent resin, and a case of metal or nontransparent resin is described first, and a case of translucent resin is described second). One end of the main lens holder 30 is fixed onto the surface of the light source holder 32 (or onto the substrate 33 of the main light source 26) so as to surround the main light source 26, and the main lens 29 is fitted into (or formed integrally with) the other end of the main lens holder 30. When the main lens holder 30 is formed of metal or nontransparent resin, all light rays emitted from the main light source 26 pass through and are outputted from the main lens 29, whereas when the main lens holder 30 is formed of translucent resin, most of the light pass through and are outputted from the main lens 29, but a part of the light pass through the main lens holder 30 made of translucent resin, and then are outputted.

The light source holder 32 is formed of a bonded plywood such as a strip-shaped silicon substrate and a printed circuit board, a copper plate, an aluminum plate, and the like. In the present embodiment, the light source holder 32 is formed by bonding a glass epoxy board onto both sides of an aluminum plate or a copper plate which is used as a core. On both surfaces of a first end, i.e., free end, of the light source holder 32, a pair of main lights 25 is fixed such that backsides (surfaces opposite to those emitting light) thereof face each other. In addition, the main lights 25 are mounted such that virtual images S, which are produced when the main lights 25 are turned on, are situated at an identical point on the backside of the main lights 25.

On both surfaces of the light source holder 32, feeder circuits 36 are formed (FIG. 1), and power is supplied to the respective main light sources 26 through the feeder circuits 36 (in the case of the aluminum plate, the main light sources 26 and the aluminum plate are electrically insulated, and power is supplied to the main light sources 26 through a conductive wire).

The light source holder 32 is formed of a highly thermal conductive material such as the above described silicon substrate, the printed circuit board, the aluminum plate, and the like, and is capable of receiving heat generated from the main light sources 26 at the same time when the main light sources 26 are turned on. That is, the light source holder 32 not only holds the main light sources 26, but also supplies power to the main light sources 26. In addition, the light source holder 32 functions as a heat sink for the main light sources 26.

The holder 16 is formed of a heat-resistant material such as ceramics and has a cylinder-like shape. As shown in FIG. 3, a first end surface of the holder 16 has a concave mirror receiving groove 40 so as to allow the central fixing cylindrical portion 24 of the concave mirror 12 to be fitted thereinto, and a light source holder fixing hole 41 into which a second end of the light source holder 32 is fitted. A second end surface of the holder 16 has power supply terminal fixing groove 42 which has the power supply terminal 18 fitted thereinto, and a lead wire insertion hollow 44 which has lead wires 38 inserted therethrough. Moreover, the light source holder fixing hole 41 and the lead wire insertion hollow 44 are communicated with each other in the central portion of the holder 16 such that the feeder circuits 36 arranged on both surfaces of the light source holder 32 are connected to the lead wires 38. Furthermore, the concave mirror 12, the light source holder 32, and the power supply terminal 18 are respectively fitted into the holder 16, and bonded to the holder 16 with an inorganic adhesive or the like. As the inorganic adhesive, an alumina-silica ($Al_2O_3$—$SiO_2$) type, an alumina ($Al_2O_3$) type, or a silicon carbide (SiC) type inorganic adhesive may be applied. Furthermore, in the case where a temperature of the main light sources 26 during emitting light is relatively low, epoxy resin can be used as the adhesive.

The power supply terminal 18 is an electrode that receives power from the outside, and composed of a base electrode 18*a*, a central electrode 18*b*, and an insulator 18*c* which insulates the base electrode 18*a* from the central electrode 18*b*. The base electrode 18*a* is formed of conductive metal and has a cylindrical shape. The outer surface of the base electrode 18*a* has a screw-thread cut so as to be screwed into a light emitting device receiving socket, which is not shown. The central electrode 18*b* is made of a conductive metal wire, and is connected to one end of the base electrode 18*a* via the insulator 18*c*. In addition, one ends of the respective lead wires 38 are electrically connected to the base electrode 18*a* and the central electrode 18*b*, respectively, and the other ends of the lead wires 38 pass through the lead wire insertion hollow 44 of the holder 16 and are electrically connected to the feeder circuits 36 arranged on the light source holder 32.

The light emitting device 10 is, for example, manufactured in accordance with the following procedure. The main lights 25 are bonded onto the light source holder 32. The light source unit 14 is prepared by electrically connecting the feeder circuits 36 arranged on the light source holder 32 to the main light sources 26 of the main lights 25 in advance. The power supply terminal 18 is fitted into the second end of the holder 16, and the light source unit 14 is fitted into the first end of the holder 16. Then, the base end of the light source unit 14 is inserted and positioned into the central fixing cylindrical portion 24 of the concave mirror 12, such that a point of virtual images S of the main light sources 26 is aligned at the focal point F1 of the ellipsoid constituting the light reflection surface 20, and then the holder 16 is fixed with the central fixing cylindrical portion 24.

Figure 5:
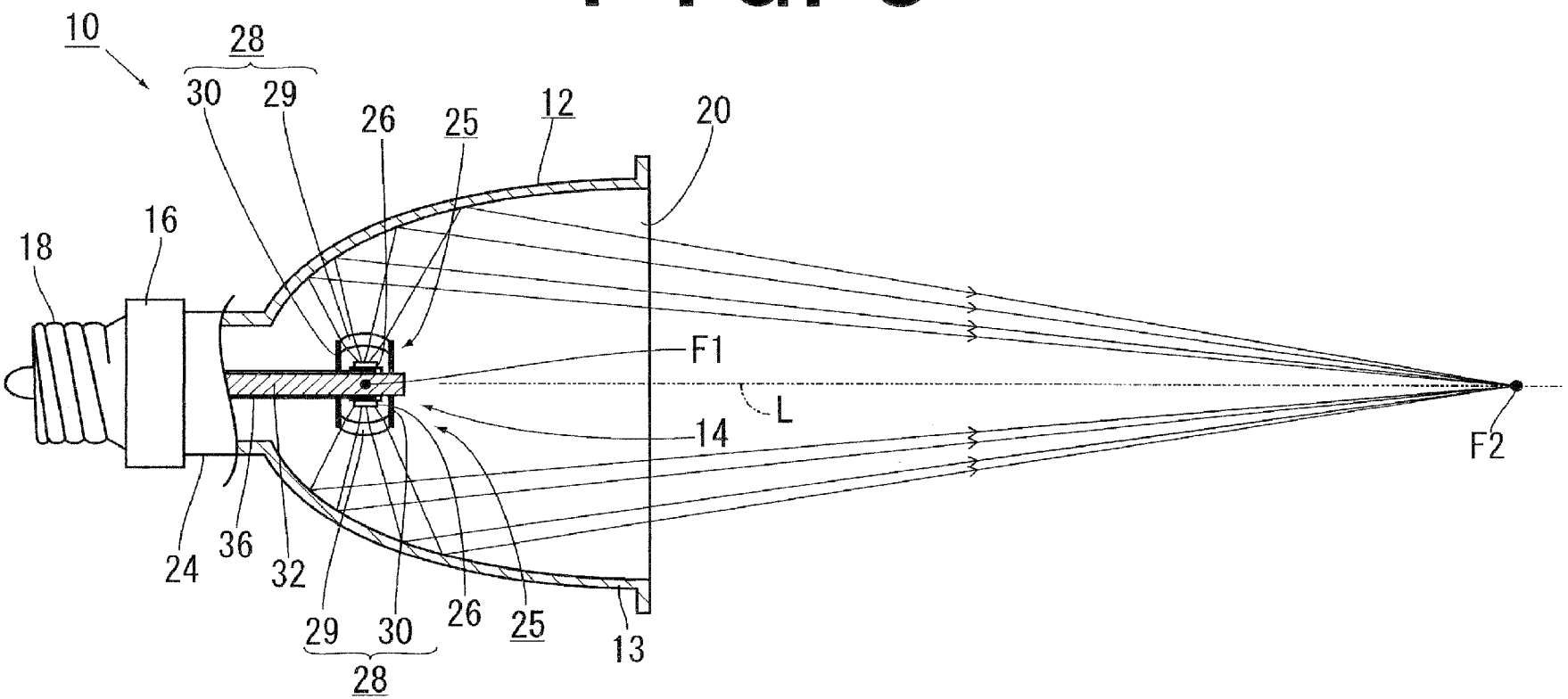

When power is supplied to the power supply terminal 18 of such manufactured light emitting device 10, the power is supplied to the main light sources 26 through the lead wires 38 and the feeder circuits 36 arranged on the light source holder 32, and then the main light sources 26 start to emit light. The light emitted from each of the main light sources 26 is refracted on the surface of the corresponding main lens 29, reflected on the light reflection surface 20, and then outputted from the light emitting device 10 through the light-emitting opening 22. Each virtual image S of the main light source 26 formed by the main lens 29 is situated at the focal point F1 of the light reflection surface 20 of the concave mirror 12, and thus, as shown in FIG. 5, all the light, which are emitted from each main light source 26 and refracted on the corresponding main lens 29, travel as if the lights are emitted from the focal point F1 of the light reflection surface 20 of the concave mirror 12, the focal point F1 having the virtual image S situated thereon, and are reflected on the light reflection surface 20 of the concave mirror 12, and are converged at the light converging point F2 situated outside the light emitting device 10.

Next, a case where the main lens holder 30 is formed of transparent or semi-transparent resin is described. When the main lens holder 30 is formed of the transparent or semitransparent resin, and when the main lens 29 cannot receive all light emitted from each main light source 26 since the main lens 29 is small with respect to the light radiation angle θ of the main light source 26, such light (=stray light) is produces that is transmitted through the main lens holder 30 and deviates from a radiation range of the light emitting device 10. Produce of the stray light leads to deterioration in efficient use of the light emitted from the main light source 26, and in addition, causes "glare" to those who are in the surrounding area.

Figure 6:
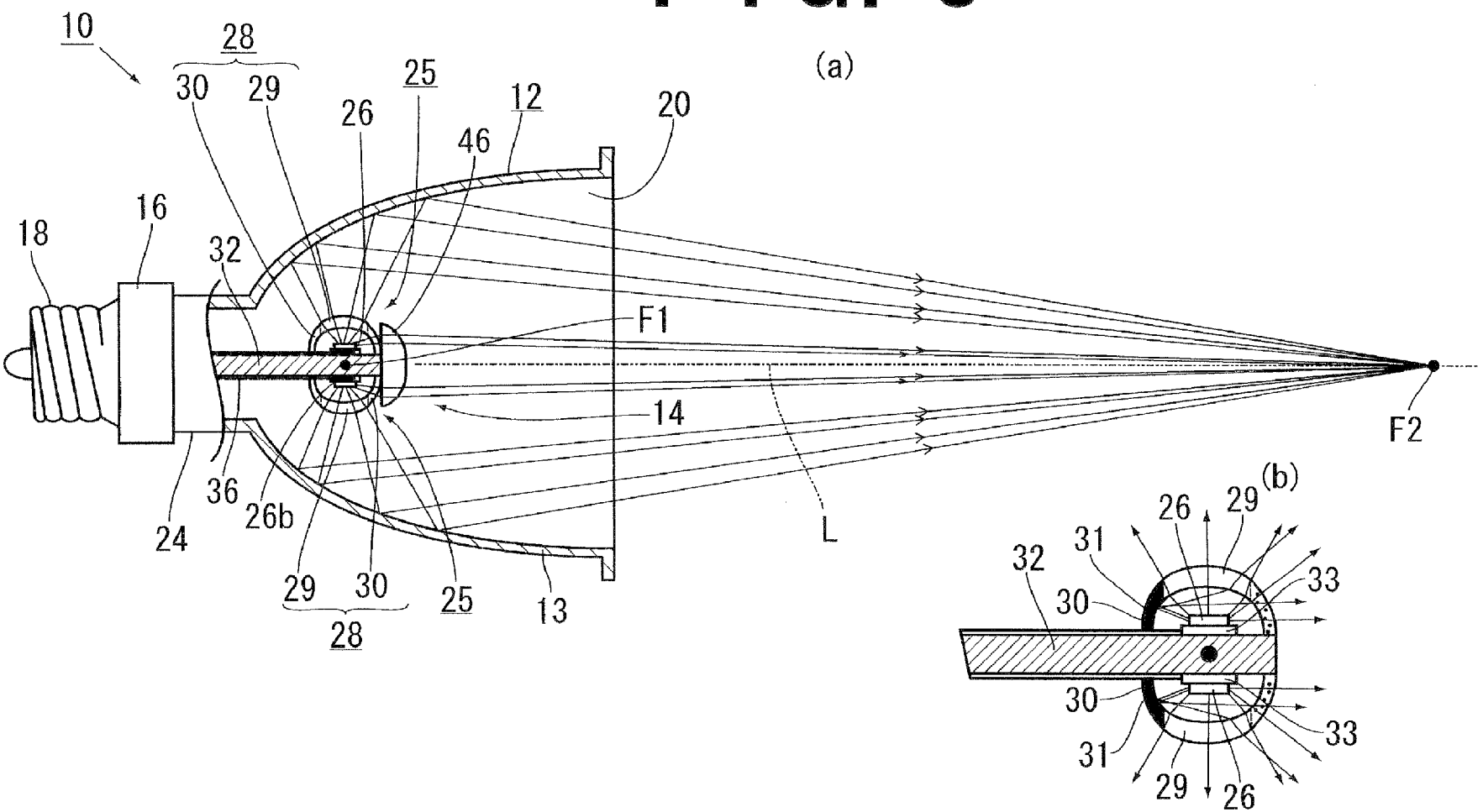
FIG. 6 is a diagram showing a light emitting device according to a modified first embodiment.

In this case, as shown in FIG. 6, a correcting lens 46 is arranged. With the correcting lens 46, the light, which deviates from the main lens 29 and is transmitted through the main lens holder 30 on the emitting side from the main light source 26 in the light emitting device 10, is refracted and converged at the light converging point F2. In this manner, when the correcting lens 46 is arranged so as to cause the stray light to converge at the light converging point F2, the stray light is converted into converging light, and consequently it is possible to use the light from the main light sources 26 more efficiently. Also, it is possible to reduce the "glare" to those who are in the surrounding area. Moreover, main lens non-transmitted light reflection film 31 (or a main lens non-transmitted light reflection surface, which is not shown) such as that made of aluminum or the like may be arranged on the surface of the main lens holder 30, the surface facing the correcting lens 46. Accordingly, it is possible to use the light further more efficiently.

Figure 7:
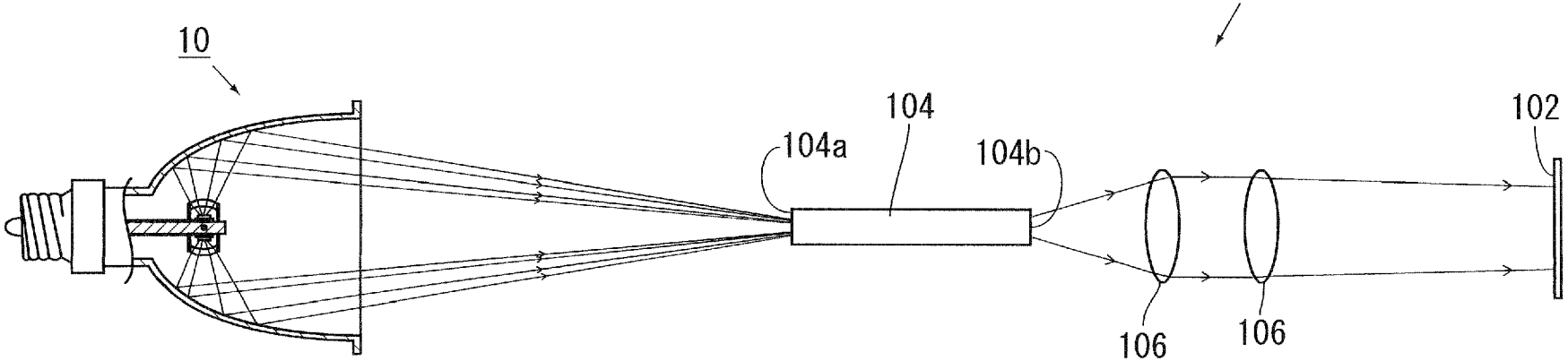
FIG. 7 is a schematic view showing an optical system using the light emitting device according to the first embodiment.

An optical system 100 shown in FIG. 7 is an example of an optical system using the light emitting device 10 according to the present embodiment. The optical system 100 irradiates a micro display such as a liquid crystal display (LCD), a digital mirror device (DMD), and the like, which is an irradiation surface 102, and includes a light emitting device 10, the irradiation surface 102, a rod main lens 104 of a square pole shape, and a pair of convex main lenses 106. The rod main lens 104 is an optical member that creates uniform illuminance distribution of light incident on its first end surface 104*a* and outputs the light from its second end surface 104*b*. The light outputted from the light emitting device 10 enters inside the rod main lens 104 from the first end surface 104*a* of the rod main lens 104, passes inside the rod main lens 104, and is outputted from the second end surface 104*b* of the rod main lens 104 while having uniform illuminance distribution. The light outputted from the second end surface 104*b* of the rod main lens 104 irradiates the irradiation surface 102 after passing through a pair of convex main lenses 106.

According to the light emitting device 10 according to the present embodiment, the light outputted from the light emitting device 10 is converged on the first end surface 104*a* of the rod main lens 104, and thus it is possible to maximize an amount of light irradiating the irradiation surface 102. The above-described features are applicable to the second embodiment (except for the light reflection surface 20).

Second Embodiment

In the same manner as the first embodiment, the light emitting device 10 according to the second embodiment also includes the concave mirror 12, the light source unit 14, the holder 16 for holding the light source unit 14, and the power supply terminal 18. In the first embodiment, the light reflection surface 20 is constituted of an ellipsoid, whereas, in the second embodiment, the light reflection surface 20 is constituted of a paraboloid. The constitution of the light reflection surface 20 is the only different point between the embodiments, and the first embodiment is incorporated for those common component parts in the present embodiment. Accordingly, the different light reflection surface 20 is mainly described with reference to FIGS. 1 to 3.

The light reflection surface 20 of the light emitting device 10 according to the second embodiment has a paraboloid centered on the central axis L. The "paraboloid" has a feature that causes all the light emitted from the focal point F1 and reflected on the paraboloid to travel in parallel, mutually, as parallel light.

In the same manner as the first embodiment, the light emitting device 10 according to the second embodiment has two sets of main lights 25 each composed of an LED 26 and a main lens 29. In the same manner as the first embodiment, each main lens 29 generates a virtual image S of the main light source 26 at the focal point F1 situated at the backside of the main light source 26. In addition, light travels as if emitted from the focal point F1, is reflected on the light reflection surface 20 of the concave mirror 12, and is outputted from the light-emitting opening 22 as parallel light.

Figure 8:
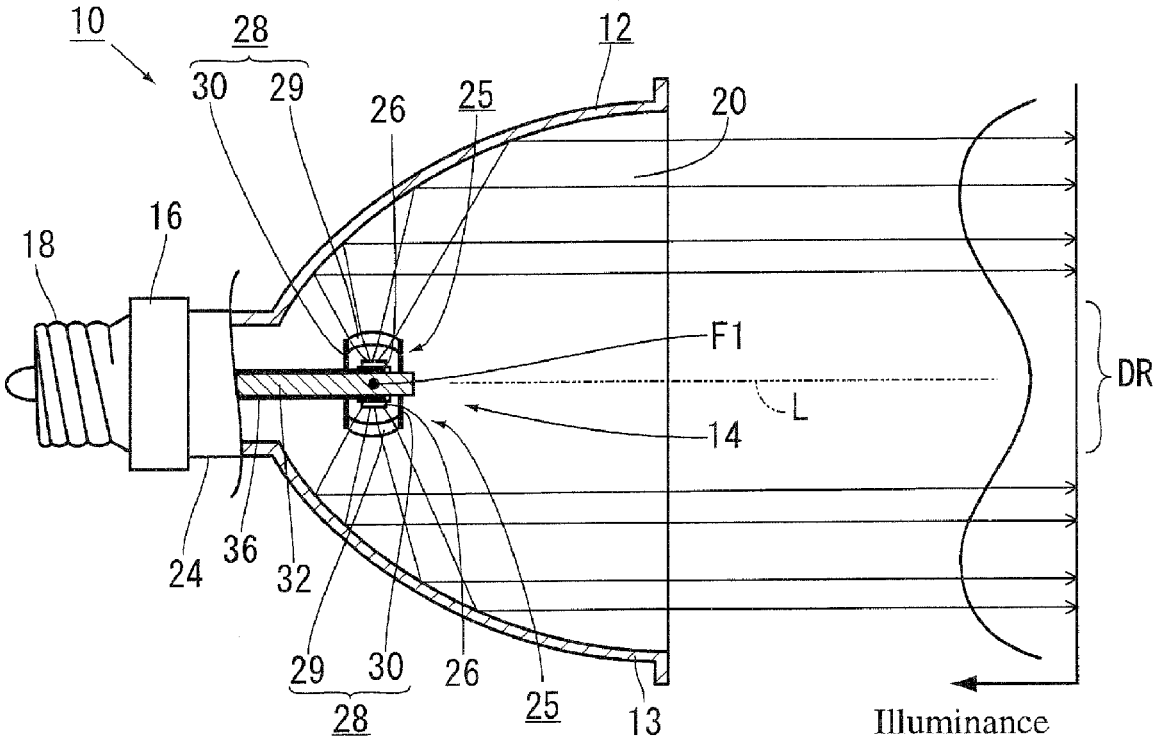

In the light emitting device 10 according to the second embodiment, two main light sources 26 are arranged distant from each other, and the light source holder 32 is disposed between both of the main light sources 26. Since light outputted from the light emitting device 10 is parallel light, as shown in FIG. 8, a slightly dark region (represented as a slightly dark region DR) compared to its surrounding area is produced at an area on and around the point of the central axis L in illuminance distribution of the light outputted from the light emitting device 10, although such produce of the dark area depends on a degree of overlapping of light on the irradiation surface.

Figure 9:
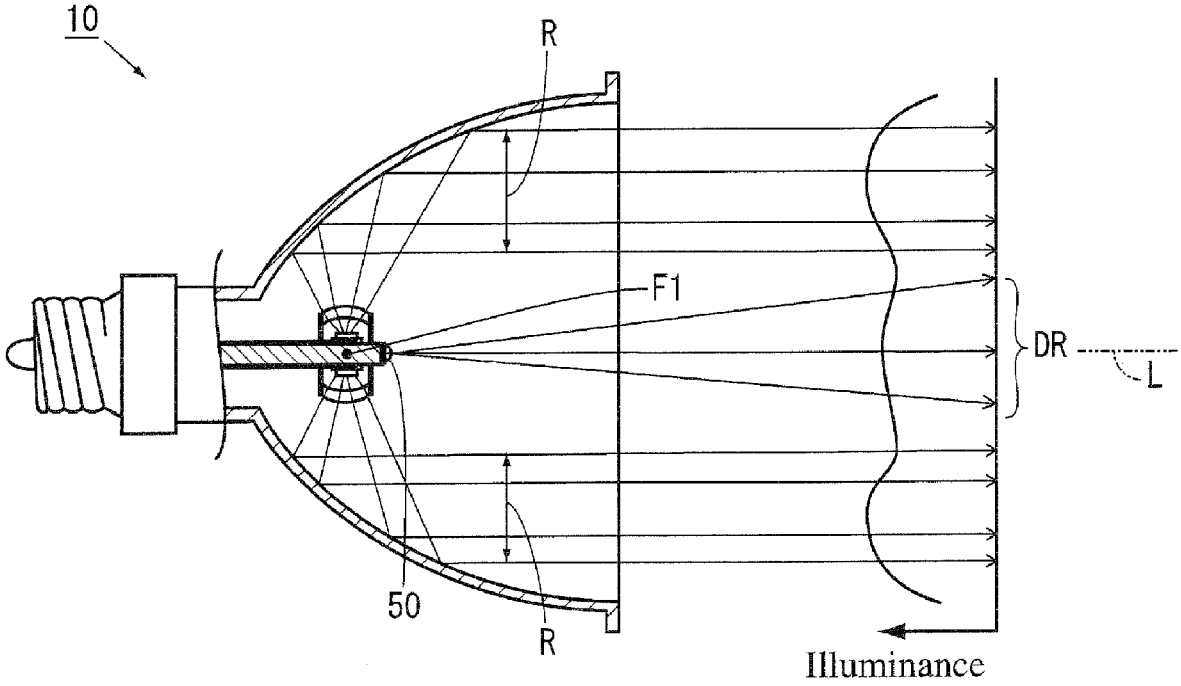
FIG. 9 is a diagram showing a light emitting device according to a modified second embodiment.

Thus, as shown in FIG. 9, it is preferable that the auxiliary light source 50 is additionally arranged on the central axis L, the auxiliary light source 50 emitting right toward a direction in which light from the concave mirror 12 is outputted is arranged. The auxiliary light source 50 has the same structure as the main light sources 26, and is arranged between reflection regions R in the concave mirror 12, and, for example, is arranged on a tip of the first end of the light source holder 32. The auxiliary light source 50 is aligned with the central axis L, and emits light toward the direction in which light from the concave mirror 12 is outputted, whereby it is possible to prevent generation of the slightly dark region DR around the central axis L, compared to its surrounding area, in the illuminance distribution of light outputted from the light emitting device 10. Accordingly, it is possible to create uniform illuminance distribution of the light outputted from the light emitting device 10. Namely, it is possible to realize illuminance having high uniformity ratio.

Moreover, a convex main lens (not shown), which causes light emitted from the auxiliary light source 50 to be refracted and converted into parallel light, may be arranged on the side of the radiation direction from the auxiliary light source 50. Accordingly, uniform illuminance distribution of light is created in the dark region DR, and it is possible to increase the uniformity ratio of the illuminance distribution of the light from the light emitting device 10.

Figure 10:
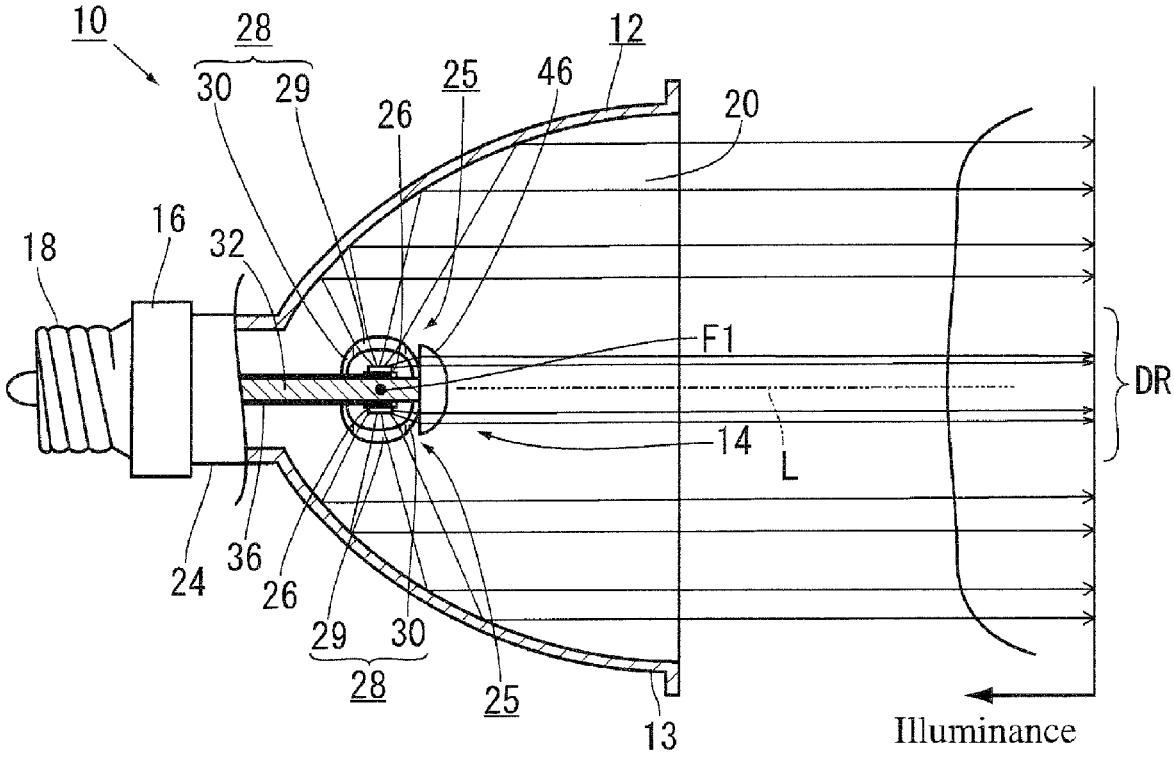
FIG. 10 is a diagram showing a light emitting device according to another modified second embodiment.

Furthermore, in the same manner as the modified first embodiment, when the main lens holder 30 is formed of transparent or semi-transparent resin, as shown in FIG. 10, a correcting lens 46 may be arranged on the side of the radiation direction from the main light sources 26 in the light emitting device 10, the correcting lens 46 causing light, which is transmitted through the main lens holder 30 and deviates from the radiation range of the light emitting device 10 (=stray light), to be refracted and converted into parallel light. With the use of the correcting lens 46 which causes the stray light to be refracted and converted into the parallel light, it is possible to use the light emitted from the main light sources 26 more efficiently, and it is also possible to reduce "glare" to those who are in the surrounding area. In addition, in the same manner as the first embodiment, a main lens non-transmitted light reflection film 31 (or main lens non-transmitted light reflection surface, which is not shown) may be provided.

Figure 11:
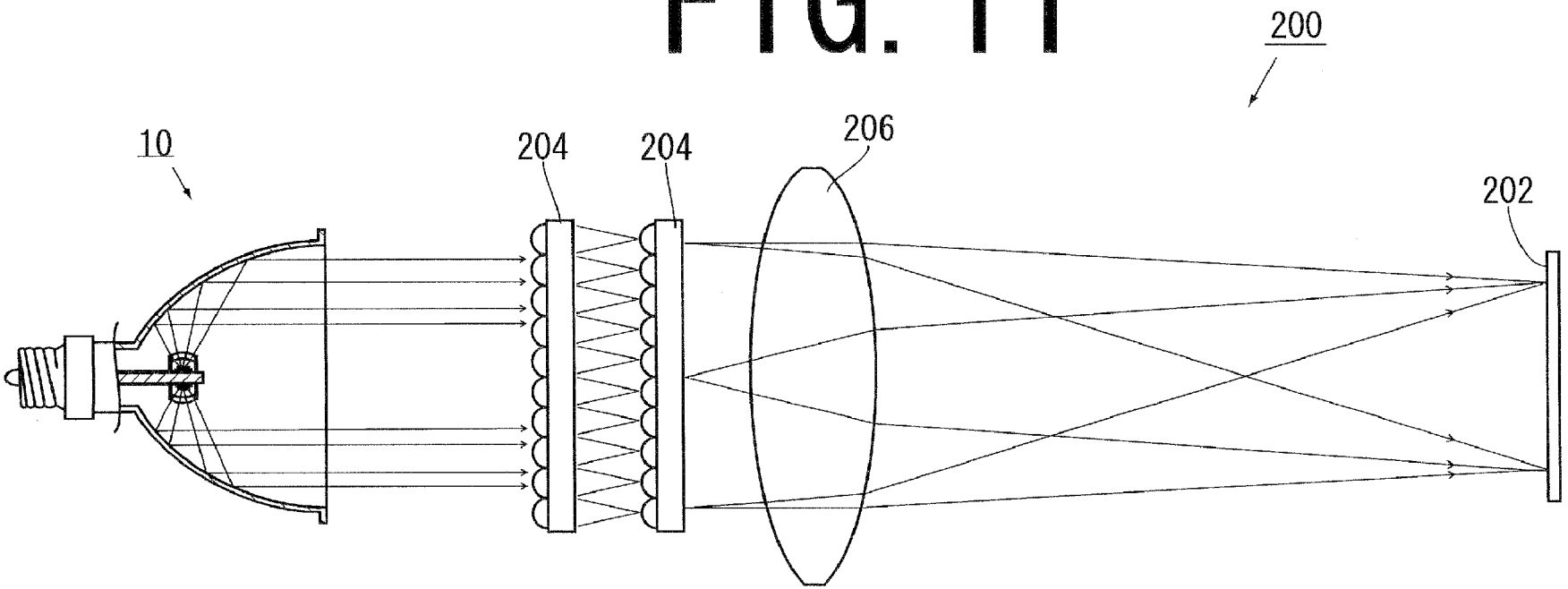
FIG. 11 is a schematic view showing an optical system using the light emitting device according to the second embodiment.

An example of the optical system using the light emitting device 10 according to the present embodiment is an optical system 200 shown in FIG. 11. The optical system 200 is used in a print circuit board exposure device so as to irradiate an irradiation surface 202 with light having uniform luminance. The optical system includes the light emitting device 10, the irradiation surface 202, a pair of fly-eye lenses 204 for creating uniform illuminance distribution of the light, and a convex main lens 206. Parallel light rays which are outputted from the light emitting device 10 pass through the pair of fly-eye lenses 204 and the convex main lens 206, and irradiates the irradiation surface 202. In the light emitting device 10 according to the present embodiment, the parallel light is outputted from the light emitting device 10, and thus uniformity of the illuminance distribution of the light is further improved with the fly-eye lenses 204. Accordingly, it is possible to irradiate the irradiation surface 202 with light having uniform illuminance distribution.

Figure 12:
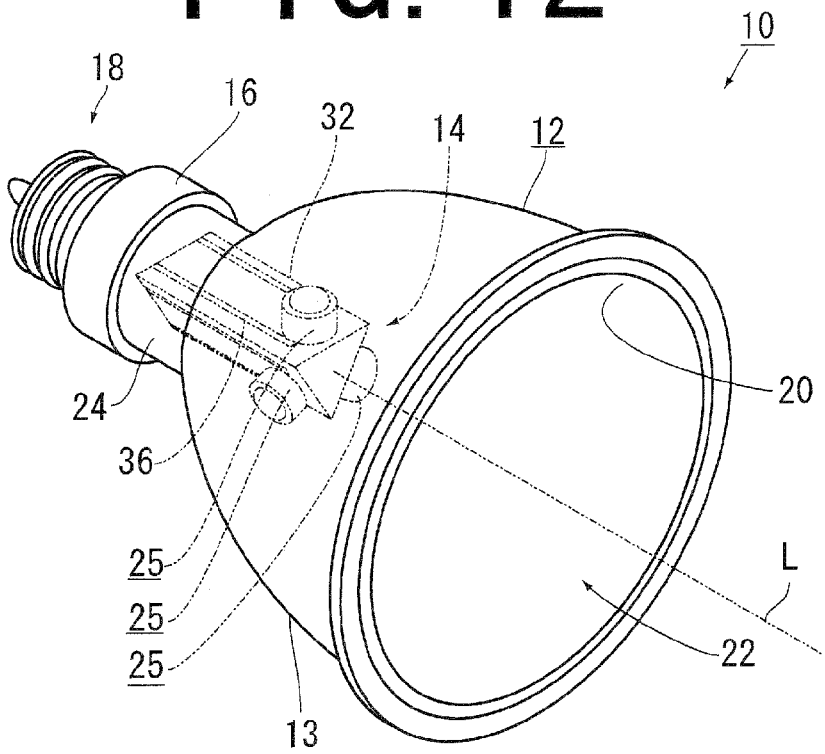
FIG. 12 is a perspective view showing a light emitting device according to another embodiment.
Figure 13:
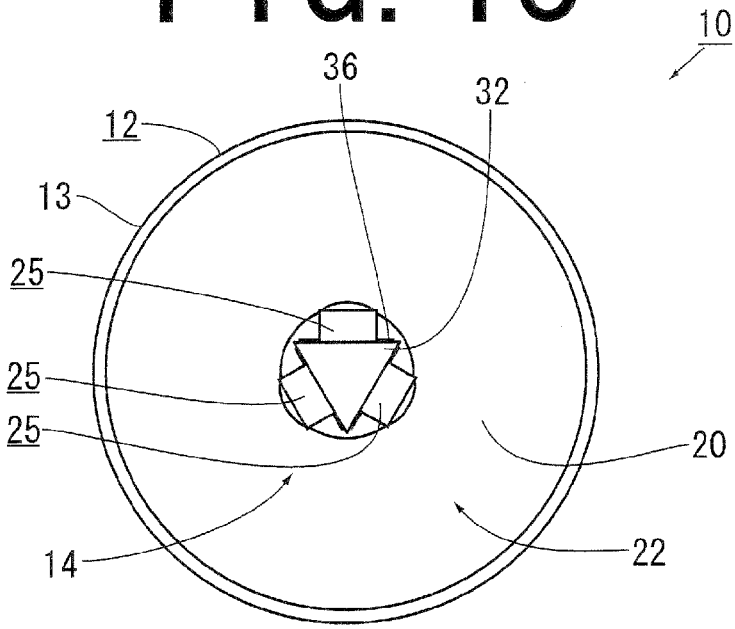
FIG. 13 is a front view showing a light emitting device according to another embodiment.
Figure 14:
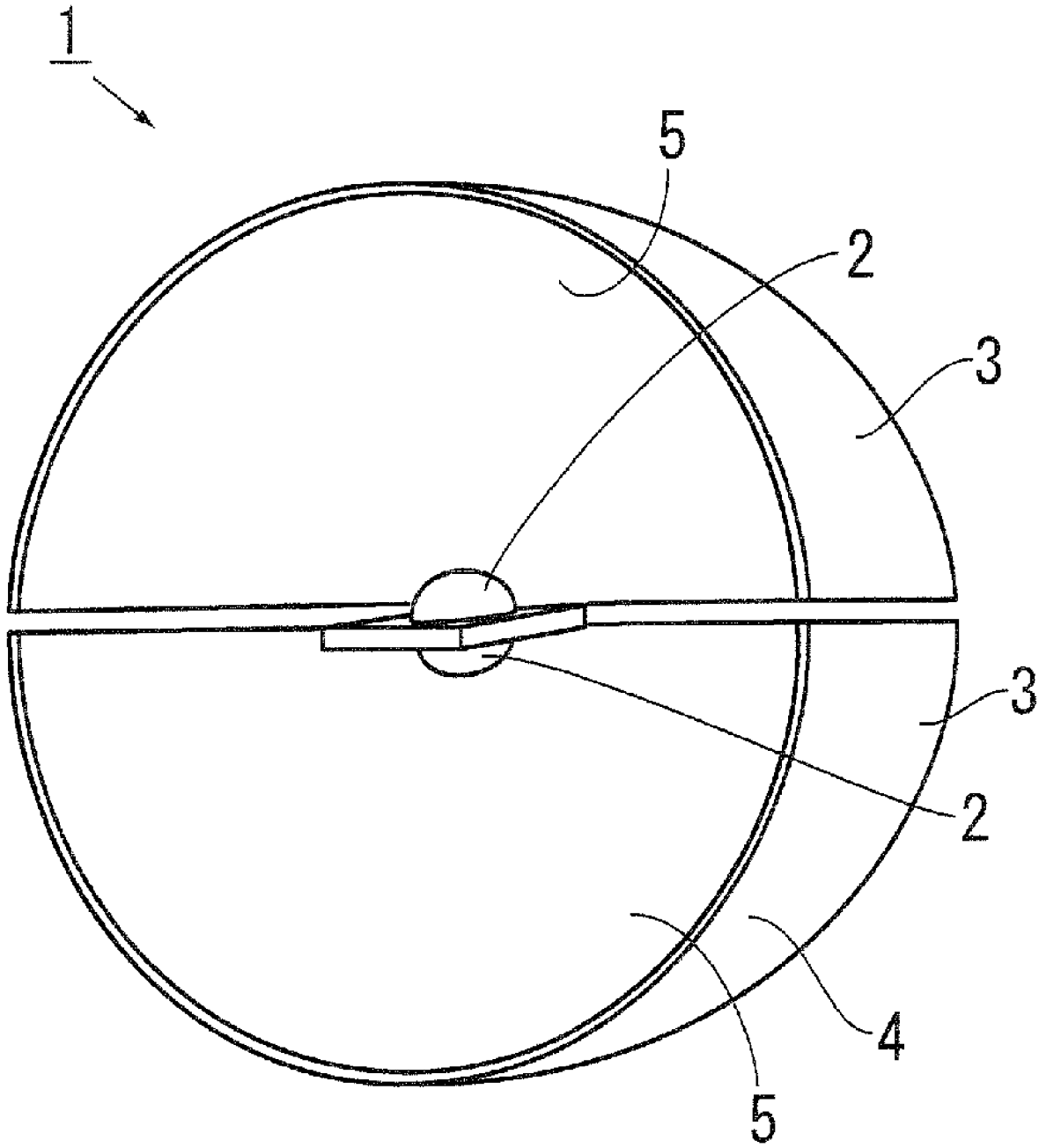
FIG. 14 is a diagram showing a conventional art.

In the above-described first and second embodiments, the case where two sets of main lights 25 are provided has been described. However, the number of the main lights 25 may be three or more. For example, FIGS. 12 and 13 shows a case where three sets of main lights 25*e*, 25*f*, and 25*g* are applied to the light emitting device 10 according to the first embodiment.

The shape of the concave mirror 12 is not limited to the above-described ellipsoid and paraboloid, provided that the shape has one focal point F1. That is, it is possible to apply a free curved surface which is formed by combining a plurality of small reflection surfaces having focal points, respectively, so that the respective focal points are aligned at an identical point.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2008-333727 filed Dec. 26, 2008 including specification, drawings and claims is incorporated herein by reference in its entirety.

What is claimed is:

1. A light emitting device, comprising:

a concave mirror having one focal point;

a plurality of main light sources each of which is arranged between the focal point and a light reflection surface of the concave mirror, and emits light toward the light reflection surface; and a plurality of main lenses each of which is arranged between a corresponding one of the main light sources and the light reflection surface, refracts the light emitted from the corresponding main light source toward the light reflection surface, and produces a virtual image of the main light source on the focal point situated at a backside of the main light source.

2. The light emitting device according to claim 1, further comprising an auxiliary light source emitting light toward an irradiation region formed by light reflected on the concave mirror, and arranged between reflection regions in the concave mirror.

3. A light emitting device, comprising:

a concave mirror having one focal point;

a plurality of main light sources each of which is arranged between the focal point and a light reflection surface of the concave mirror, and emits light toward the light reflection surface;

a plurality of main lenses each of which is arranged between a corresponding one of the main light sources and the light reflection surface, refracts a majority portion of the light emitted from the corresponding main light source toward the light reflection surface, and produces a virtual image of the main light source on the focal point situated at a backside of the main light source; and a correcting lens which is arranged on an irradiation direction side from the main light sources, and refracts light, which is not transmitted through the main lenses and travels toward the irradiation direction while deviating from an irradiation region, such that the light is directed to a predetermined irradiation region.

4. A light emitting device comprising:

a concave mirror having one focal point;

a plurality of main light sources each of which is arranged between the focal point and a light reflection surface of the concave mirror, and emits light toward the light reflection surface;

a plurality of main lenses each of which is arranged between a corresponding one of the main light sources and the light reflection surface, refracts a majority portion of the light emitted from the corresponding main light source toward the light reflection surface, and produces a virtual image of the main light source on the focal point situated at a backside of the main light source;

a correction lens which is arranged on an irradiation direction side from the main light sources, and refracts light, which is not transmitted through the main lenses and travels toward the irradiation direction while deviated from an irradiation region, such that the light is directed to a predetermined irradiation region; and a main lens non-transmitted light reflection surface arranged for each of the main light sources on a side toward the concave mirror.

5. A light emitting device comprising:

a concave mirror having one focal point;

a plurality of main light sources each of which is arranged between the focal point and a light reflection surface of the concave mirror, and emits light toward the light reflection surface;

a plurality of main lenses each of which is arranged between a corresponding one of the main light sources and the light reflection surface, refracts a majority portion of the light emitted from the corresponding main light source toward the light reflection surface, and produces a virtual image of the main light source on the focal point situated at a backside of the main light source;

a correcting lens which is arranged on an irradiation direction side from the main light sources, and refracts light, which is not transmitted through the main lenses and travels toward the irradiation direction while deviated from an irradiation region, such that the light is directed to a predetermined irradiation region; and a main lens non-transmitted light reflection film arranged for each of the main light sources on a surface of the side toward the concave mirror.

* * * * *